United States Patent [19]

Mueller

[11] Patent Number: 4,544,065

[45] Date of Patent: Oct. 1, 1985

[54] PRINTER STAND

[76] Inventor: Carl J. Mueller, 524 Iroquois Trail, Carol Stream, Ill. 60188

[21] Appl. No.: 578,674

[22] Filed: Feb. 9, 1984

[51] Int. Cl.[4] ..... A47F 7/00

[52] U.S. Cl. ..... 211/13; 211/50; 312/196

[58] Field of Search ..... 211/50, 13, 42; 312/196; 248/127, 152, 442.2, 176, 174, 459

[56] References Cited

U.S. PATENT DOCUMENTS

| | | | |
|---|---|---|---|
| 3,178,172 | 4/1965 | Lettan | 211/50 X |
| 3,346,317 | 10/1967 | Peggs | 248/174 X |
| 4,313,112 | 1/1982 | Foster | 312/196 X |

*Primary Examiner*—Robert W. Gibson, Jr.
*Attorney, Agent, or Firm*—Bernard L. Kleinke

[57] ABSTRACT

A stand for supporting a computer printer or the like includes a base adapted to support the printer at an incline. A lip is provided along the forward or lower edge of the base which extends upwardly from the base a distance sufficient to prevent the printer from sliding off the base. A bailer is positioned rearwardly of the base for receiving paper ejected by the printer and includes an upwardly extending lip to confine the paper thereon. The bailer defines a cavity for storing a supply of feed paper for the printer, and the bailer is configured to simultaneously permit feeding and bailing of paper.

6 Claims, 2 Drawing Figures

PRINTER STAND

DESCRIPTION

1. Technical Field

The present invention relates in general to stands, and in particular to stands for supporting a printer such as a computer printer or the like.

2. Background Art

The widespread popularity now enjoyed by mini or personal computer systems has served to highlight the need to develop new ways to support the system components by means other than simple placement on a desk top or table. This is especially true with regard to a computer printer since arrangements must be made for storing a supply of printer paper, and for bailing the paper after passage through the printer.

Because most desks are of somewhat limited surface area, it would be highly desirable to provide a stand for supporting the printer and paper which makes more effective use of space. In this regard, computer printers, or the like, are relatively large pieces of equipment, which are not conveniently supported on top of some conventional sized desks, and still have adequate room for receiving printed paper webs being transferred from the printer. In some applications, the printed paper web is merely allowed to fall on the floor behind the printer. Such a technique is not at all acceptable or desirable for many applications.

Further, since it is often times quite difficult and awkward for an operator to manipulate the printer controls and read the printed text while seated, it would also be highly desirable to provide a printer stand which facilitates greatly the ability of the operator to reach the controls and to view the printed paper web as it is being fed from the printer.

Still further, along with the foregoing features it would also be highly desirable to provide a printer stand, including a paper bailer, which would receive printed paper from the printer, without interfering with the passage of paper being fed to the printer, and which would permit the use of various sizes of paper. In this regard, it would be highly desirable and expeditious to have such a stand, which would not only facilitate the manipulation of the printer controls and the reading of the printed text, but also be equipped to receive the printed paper web coming from the printer, without interference with the passage of paper thereto. Such a printer stand should possess all of these features, and at the same time, be able to occupy a much smaller space on a supporting surface, as compared to prior known computer printer stands. Moreover, such a stand should enable the use of various different sizes of paper to be used with the printer.

While numerous stands and bailers, such as exemplified by U.S. Pat. Nos. 2,548,715; 2,656,098; 2,920,244; and 2,943,243, have been developed for use in conjunction with equipment other than computer printers and the like, they are not altogether satisfactory for the purposes as stated herein. Accordingly, the need still exists to provide a printer stand which embodies the aforementioned desirable features.

DISCLOSURE OF THE INVENTION

In view of the foregoing, an object of the present invention is to provide a printer stand which makes more effective use of the space where the stand is situated.

Another object of the present invention is to provide such a printer stand which enables an operator, while in a seated position, to more conveniently manipulate a printer's controls and read printed text.

A still further object of the present invention is to provide such a printer stand which can be readily adapted to hold various sizes of printer paper.

Yet another object of the present invention is to provide such a printer stand which can bail paper ejected from a printer without interfering with the passage of feed paper to the printer, a feature which is especially desirable when the printer paper consists of a stock of continuous web, fan-folded paper.

Another object of the present invention is to provide such a printer stand which can be formed either as a modular unit adapted for placement on a desk top, or as an integral part of an article of furniture.

Yet another object of the present invention is to provide such a printer stand of simplified construction which is adapted for manufacture at a relatively low cost, and which possesses all of the foregoing features, while occupying a relatively small amount of space on a supporting surface.

Briefly, the above and other objects of the present invention are realized by providing a printer stand which includes a base unit adapted to support a printer and a bailer unit adapted to receive printer paper as the paper is ejected from the printer.

The base unit defines an inclined support surface which is dimensioned to receive and support a printer in an inclined position. A lip is formed along the forward or lower marginal edge of the support surface and extends upwardly from the surface a distance sufficient such that one side of the lip abuttingly engages the printer to prevent it from sliding off the base unit.

The bailer unit defines a paper-supporting surface which is positioned rearwardly of the rear or upper marginal edge of the base unit's inclined support surface. A lip is formed along the marginal edge of the paper-supporting surface which is remote from the base unit and extends upwardly from that surface a distance sufficient to confine the paper.

In one form of the invention, the bailer unit additionally defines a cavity under the paper-supporting surface which is sized to receive and support a supply of continuous web, fan-folded, printer paper. This form of the invention enables paper to be fed directly to the printer, and then bailed after ejectment from the printer.

BRIEF DESCRIPTION OF THE DRAWINGS

The above-mentioned and other objects and features of this invention and the manner of attaining them will become apparent, and the invention itself will be best understood by reference to the following description of an embodiment of the invention taken in conjunction with the accompanying drawings, wherein:

FIG. 1 is a perspective view of a printer stand constructed in accordance with the present invention, the stand being of modular construction and deployed atop a desk or the like.

BEST MODE FOR CARRYING OUT THE INVENTION

Figure 1:
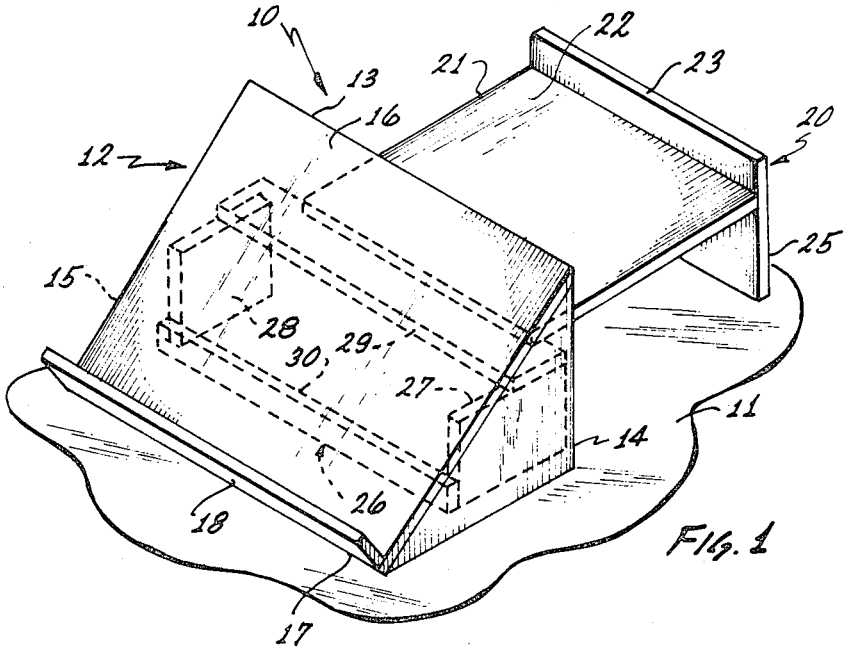

Referring now to the drawings, and in particular to FIG. 1, there is shown a printer stand 10 constructed in accordance with this invention as adapted for deployment atop a desk 11. While the stand 10, as illustrated, is embodied in the form of a modular unit, it will be readily understood from the ensuing description that the characterizing features of the invention can also be incorporated as an integral part of desk 11. Accordingly, it is not intended to limit the invention to embodiments thereof which are solely in modular form.

Figure 2:
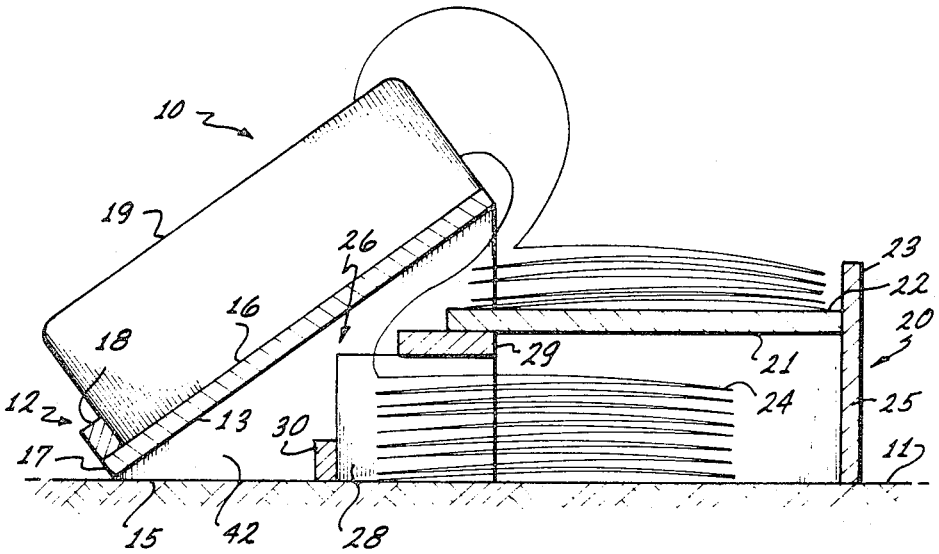
FIG. 2 is a cross-sectional side view of the stand shown in FIG. 1, illustrating the stand supporting a computer printer and a supply of continuous web, fan-folded, printer paper.

The stand 10 generally comprises a base unit 12 including a forwardly inclined planar member 13 having a forwardly and upwardly projecting lip member 18 at the bottom edge thereof, to support a printer 19 at an incline of desk 11. A pair of spaced apart, vertical triangularly-shaped side walls or members 14 and 15 are fixed to the side edges of the inclined planar member 13. The upper face 16 of the planar member 13 defines a printer-supporting surface. The upward extension of lip member 18 is selected to ensure abutting contact between lip member 18 and a printer 19, as shown in FIG. 2.

The stand 10 further comprises a bailer unit 20 positioned rearwardly of base unit 12, and includes a horizontal planar member 21 having its upper surface 22 defining a paper-supporting surface for receiving and supporting paper from the printer 19. A lip member 23 is fixedly secured to planar member 21 and extends upwardly from surface 22 a distance sufficient to ensure that paper is retained thereupon.

As thus far described, stand 10 is entirely satisfactory for supporting printer 19 in a preferred position of alignment, i.e. — inclined, with respect to the operator thereof, and for bailing paper ejected from the printer. However, as previously discussed it is also an object of the present invention to adapt it for use with a paper supply of continuous web, fan-folded, printer paper. This adaptation is realized by supporting planar member 21 in substantially horizontal, elevated alignment over desk ll, thus defining a space or cavity between the underside of planar member 21 and desk 11 capable of receiving a feed paper supply 24 of the fan-folded type.

In the illustrated embodiment planar member 21 is supported at one end over desk 11 by a vertical leg member 25. The opposite end of planar member 21 is supported in a cantilevered manner by a movable support assembly 26 comprising a spaced apart pair of rectangular vertical blocks or members 27 and 28 fixed to the inner faces of the respective side members 14 and 15, and a spaced apart pair of cross-members 29 and 30. It will be noted that a horizontal slot is defined between cross members 29 and 30, thus enabling paper from paper supply 24 to communicate through support assembly 26 and serve as a feed for printer 19. It will also be noted that the path of travel followed by the paper feeding printer 19 does not interefere with the path of paper ejected from printer 19 and bailed upon bailer unit 20.

The elongated cross member 30 is fixed at its opposite ends to the lower front edges of the vertical member 27 and 28 to serve as a reinforcing member. The elongated cross member 29 rests freely on the rear portions of the upper edges of the vertical members 27 and 28, and can be removed to facilitate placement of the paper 24 in the position on top of the desk 11 partly within the rear compartment or cavity 42 on the underside of the base and extending under the bailer unit 20. When the strip 29 is replaced on top of the members 27 and 28, the front edge of the bailer member 21 can be placed on the top thereof.

While a particular embodiment of the present invention has been disclosed, it is to be understood that various different modifications are possible and contemplated within the true spirit and scope of the appended claims. For example, the component of the device of the present invention may be incorporated as integral parts of the structure of a desk. Also, while the base unit 12 is shown as being hollow, thus allowing the bailer unit 20 to be partially received therein, such is not a necessary feature of the invention. Similarly, the manner by which planar member 21 of bailer unit 20 is supported above a surface to define a cavity for receiving a paper supply therein can take many other forms. Therefore, there is no intention to limit the present invention to the exact abstract or disclosure herein presented.

I claim:

1. A stand for supporting a computer printer or the like, comprising a base unit defining a first support surface dimensioned to receive a printer or the like thereupon and inclined relative to horizontal, and a lip member along at least a portion of the forward or lower marginal edge of said first support surface and extending upwardly therefrom, said lip member being engagable on one side thereof with said printer whereby to prevent said printer from sliding off said first support surface, said base unit having a first cavity subjacent said first support surface dimensioned to receive at least partially a supply of continuous-web folded paper for said printer, said base unit having as rear opening, communicating with said first cavity, a separate bailer unit positioned rearwardly of said base unit, said bailer unit defining a second support surface dimensioned to fit telescopically through said rear opening of said base unit and into said first cavity, and to receive refolded paper thereupon ejected by said printer, said bailer unit further defining a second cavity subjacent said second support surface and having a front opening for communicating with said rear opening in said base unit and being dimensioned to receive partially the supply of continuous-web paper for said printer to permit said first and second cavities to communicate and to permit said paper to be positioned wholly within the combination of said first and second cavities, a cross member for said bailer unit extending across the inside of the first cavity of said base unit and having an edge spaced inwardly from said rear opening at a position above the paper near the front edges thereof disposed within said first cavity for guiding said continuous-web paper upwardly and rearwardly out of said first cavity and to the printer.

2. A stand according to claim 1, wherein said second support surface includes a marginal edge, and further comprising a lip member along at least a portion of the marginal edge of said second support surface remote from said base unit and extending upwardly therefrom.

3. A stand according to claim 1, wherein said cross member supports said second support surface thereon to help support said bailer unit extending partially within said first cavity.

4. A stand according to claim 3, wherein said cross member forms a portion of a support assembly disposed within said first cavity, said assembly including a pair of vertical support members disposed at opposite ends of said cross member.

5. A stand according to claim 3, wherein said assembly further includes a second cross member, said cross member being spaced apart to define a horizontal feed slot for the paper.

6. A stand according to claim 5, wherein the front portion of said second support surface rests on top of a portion of the first-mentioned cross member within said second cavity.

* * * * *